United States Patent [19]

Smith

[11] 4,373,510

[45] Feb. 15, 1983

[54] VENTING SYSTEM FOR OIL OR GAS-FIRED APPLIANCES

[76] Inventor: Donald L. Smith, 452 Nassau Ave., Bolingbrook, Ill. 60439

[21] Appl. No.: 141,261

[22] Filed: Apr. 17, 1980

[51] Int. Cl.[3] ..... F23J 11/00; E04F 17/04

[52] U.S. Cl. ..... 126/307 A; 98/48

[58] Field of Search ..... 126/84, 307 A, 293, 126/307 R, 312, 99 D, 115; 98/48; 110/160

[56] References Cited

U.S. PATENT DOCUMENTS

| | | | |
|---|---|---|---|
| 2,165,811 | 7/1939 | Peters | 126/307 A |
| 2,222,663 | 11/1940 | Handley | 126/307 A |
| 2,353,179 | 7/1944 | Morris | 126/307 A |
| 2,734,501 | 2/1956 | Fauser, Jr. | 126/307 A |
| 2,888,911 | 6/1959 | Thompson | 126/307 A |

*Primary Examiner*—Samuel Scott
*Assistant Examiner*—G. Anderson
*Attorney, Agent, or Firm*—Mawhinney & Mawhinney & Connors

[57] ABSTRACT

A venting system for the combustion chamber of an oil or gas-fired heating appliance has an elongate diverter box arranged vertically exteriorly of the heating appliance. Such diverter box has an upper end tightly closed off by an insulated imperforate cover and a relief open lower end closed for safety by a perforate grill in which a safety spill switch is mounted. The interior of the diverter box houses a vertically disposed centrally arranged insulated baffle having an upper end in fume tight engagement with cover and a lower free end terminating substantially above the grill. The baffle divides the box into a flue gas inlet section that is connected at the upper portion of the box to the appliance and a vent gas outlet section that is connected at the upper portion of the box to the chimney flue. The inlet section has a turning vane provided on the end wall just below the lower free end of the center baffle. During the burn cycle, the flue gases from the flue outlet of the appliance enter into the upper end portion of the inlet section on one side of the center baffle and travel downward to the lower free end of the baffle before entering the vent outlet section to travel on out the chimney flue.

5 Claims, 3 Drawing Figures

FIG. 1
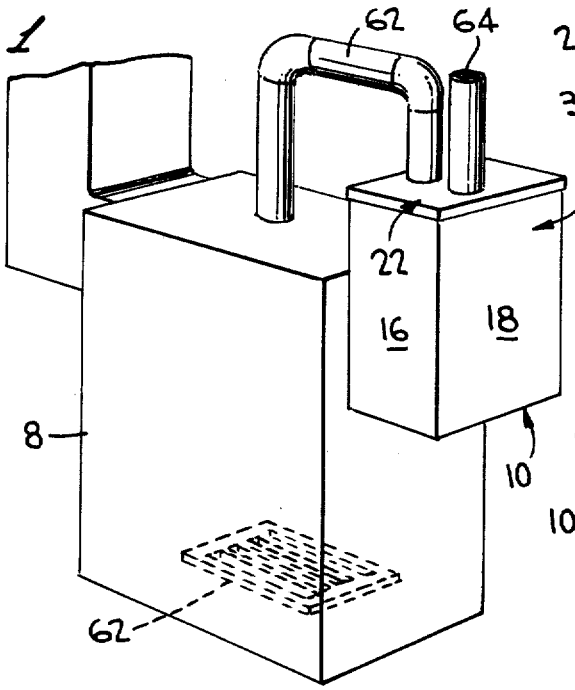
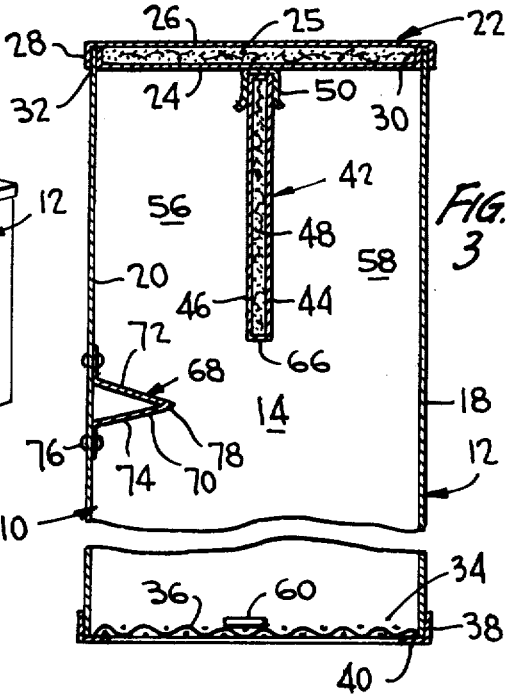
FIG. 3
FIG. 2
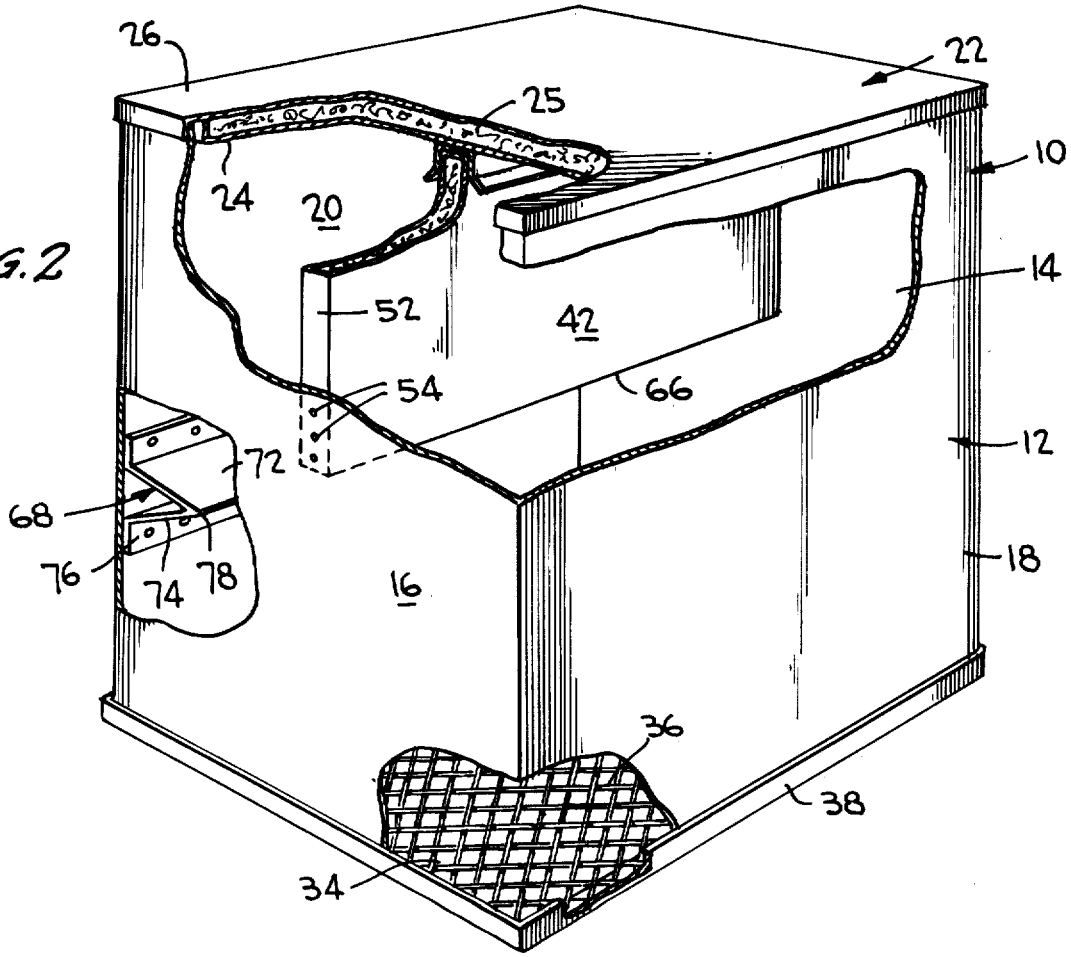

VENTING SYSTEM FOR OIL OR GAS-FIRED APPLIANCES

BACKGROUND OF THE INVENTION

1. Field of the Invention

The present invention appertains in general to new and novel improvements in oil or gas-fired appliances, including forced combustion wood burning appliances and fireplaces, stoker coal-fired heating plants and warm-air furnaces, boilers and water heaters, and particularly relates to a new and novel system for venting such appliances.

2. State of the Art

The present invention, in particular, relates to new and novel improvements in my prior U.S. Pat. No. 4,079,727 issued Mar. 21, 1978.

Known venting systems function to evacuate combustion products, which may contain carbon monoxide, from the appliance through the flue outlet to the chimney. The venting systems generally incorporate a draft hood or diverter which functions to: (1) provide for the ready escape of the products of combustion in the event of no draft, back draft, or stoppage beyond the draft hood (blocked chimney); (2) prevent a back draft from entering the appliance; and (3) neutralize the effect of stack action (up draft) of the chimney flue upon the operation of the appliance.

During the burn cycle of the appliance, such conventional venting systems do nothing to slow down the velocity of the heat traveling through the appliance's heat exchanger, which results in considerable loss of this heat up through the chimney flue. Nor do they do anything to reduce the volume of excess air drawn into the combustion chamber which dilutes or weakens the heat produced in the flame and also is the principal reason for less than ultimate combustion efficiency. Consequently, more combustion of fuel is required to perform the function of the appliance.

During the appliance's off cycle, such conventional venting systems do nothing to "lock in" the pilot heat and residual heat in the appliance.

Such means as automatic vent dampers have been used to retain some of the pilot heat and residual heat in the off cycle, but these employ electrical and/or mechanical means of operation.

None of the known venting systems deals with the dual facets of safe performance and conservation of fuel. In conventional methods of venting appliances, (1) heat is always permitted to travel very rapidly through the heat exchanger and up the chimney flue; (2) large volumes of excess air are permitted to be drawn into the combustion chamber; and (3) the loss of pilot heat and residual heat from the appliance in the off cycle is permitted, except when electrically and/or mechanically operated automatic vent dampers are used.

Furthermore, stationary internal baffles within known venting systems are utilized only to deflect the flow of flue gases and/or the flow of the air through the relief opening induced by the chimney flue and none of these serve to form a "heat lock" which reduces the velocity of the heat moving through the appliance during the burn cycle, allowing more time for absorption of the heat by the heat exchanger. Nor do they serve to control the volume of excess air drawn into the combustion chamber which weakens the heat and lowers combustion efficiency during the burn cycle.

In addition, such stationary baffles do not serve to form a "heat lock" which stops the loss of pilot heat and residual heat from the appliance in the off cycle.

None of the conventional venting systems reduce the vent pipe temperature. And overheated vent pipes cause most, if not all, flue fires. Also, known venting systems do nothing to counteract blockages of chimney flues.

In prior U.S. Pat. No. 4,079,727 an exterior diverter box is provided and is formed with a vertical baffle that divides the interior of the diverter box into a flue gas inlet section connected to the appliance and a flue gas outlet section connected to the chimney flue. The baffle is disposed well above the lower entirely open end of the box which end lies in a horizontal plane above or, at least, in the same plane in which the bottom of the factory diverter box within the furnace is disposed when the furnace is manufactured or in some instances such as water heaters, 34" above the burner ports, or lower if determined by instrument tests to allow carbon monoxide free combustion under blocked flue conditions.

SUMMARY OF THE INVENTION

An important object of the present invention is to provide a venting system for a gas or oil-fired appliance which will perform all the normal functions of a draft hood, that is, to provide for the ready escape of the products of combustion in the event of no draft, back draft, or stoppage beyond the draft hood; to prevent a back draft from entering the appliance; and to neutralize the effect of stack action of the chimney flue upon the operation of the appliance whereby considerable savings in fuel consumption can be realized, vent pipe temperatures can be reduced, and dangers fraught with chimney flue stoppages can be eliminated.

A further important object of the present invention is to provide an improved economical, simple but highly effective venting system for a gas or oil-fired appliance which reduces the velocity of the heat traveling through the appliance's heat exchanger during the burn cycle and allows more time for that heat to be absorbed by the heat exchanger, thereby improving thermal efficiency, and reduces the volume of excess air normally drawn into the combustion chamber during the burn cycle thereby reducing the diluting or weakening of the heat from the flame as well as improving combustion efficiency.

A further important object of the present invention is to provide an improved venting system which has a stationary insulated center baffle, rather than a movable electrically and/or mechanically actuated movable damper, to form an off cycle "heat lock" of pilot heat and residual heat in the appliance and in conjunction therewith has a turning vane in the flue gas inlet section below the lower free end of the baffle to turn the gases under the baffle. The open upper end of the diverter box is sealingly closed off by an insulated imperforate cover and the open bottom, which constitutes a lower relief opening, is closed off by a grill.

A further important object of the present invention is to provide an improved venting system that can be used to replace the factory provided draft hood or internal diverter on existing appliances, and that can meet the safety and performance standards set by government regulatory agencies and trade associations.

Generally considered, the present invention provides in combination with a gas or oil-fired appliance, a venting system for the evacuation of combustion products which includes horizontally or vertically disposed pipings extending out from the flue outlet of the appliance and the chimney flue and which are interconnected and intercommunicated by the upper portion of an elongate diverter box that is vertically oriented alongside and disposed exteriorly of the appliance and has a vertical center insulated baffle dividing the upper portion into a flue gas inlet section and a vent gas outlet section with such sections being provided with temperature indicators. The inlet section has a turning vane just below the bottom of the center baffle on the vertical side wall which is parallel to the center baffle. The relief opening is provided by the open bottom of the elongate diverter box and is covered with a grill which provides a minimum of 90% free area. During the burn cycle, the flue gases from the flue outlet of the appliance enter into the inlet section on one side of the center baffle and travel downward to the lower free end of the baffle before being turned by the turning vane to enter the vent outlet section and travel on out the chimney flue. This downward turn interrupts the conventional path of the heat to the chimney and results in reduced velocity in the heat exchanger and reduced volume of excess air in the combustion chamber. During the off cycle, this downward turn "locks in" the pilot heat and residual heat which would continue to be lost up the chimney flue with conventional venting systems.

A safety spill switch is housed in one of the grill openings at the center of the relief opening of the diverter box and is intended to be activated by spillage of hot fumes from the relief opening so as to break the circuit through the automatic fuel control valve and shut off the flow of fuel to the main burners.

BRIEF DESCRIPTION OF THE DRAWINGS

FIG. 1 is a perspective view of a gas-fired heating plant, such as a typical warm-air furnace, which is shown for exemplary purposes and which is equipped with a venting system provided in accordance with the present invention.

FIG. 2 is a perspective view of the diverter box of the present invention with portions of the box being broken away to illustrate details of the interior construction of the box.

FIG. 3 is a vertical cross-sectional view of the diverter box.

DESCRIPTION OF THE PREFERRED EMBODIMENT

Referring now more particularly to the accompanying drawing, the venting system 10 of the present invention includes an elongate substantially rectangular diverter box 12, which is fabricated from 24 gauge or upward galvanized iron or other sheet material. The diverter box in use, as shown in FIG. 1, is arranged vertically exteriorly of the warm-air furnace 8 or any other type of oil or gas-fired appliance.

The diverter box 10 is composed of opposing side walls 14 and 16 and opposing end walls 18 and 20. The upper end of the box and the lower end of the box, in its initial fabrication, are open. The top of the box is tightly closed off by an imperforate cover 22. The cover 22 is fabricated as an inner lid or panel 24 and an outer lid or panel 26. The panels are spaced apart in their flat central portions that overlie the open upper end of the box and the space between the panels is filled with a packing 25 (about 1 inch thickness) of suitable insulating material, such as fiber glass.

The outer panel 26 has a downturned peripheral flange 28 while the inner panel 24 has an upturned peripheral flange 30 that complements the flange 28 and is spaced therefrom a distance approximately equal to the thickness of the end and side walls of the box to define a groove 32 in which the upper edge portions of such walls snugly fit. The flanges are spot welded or otherwise sealingly secured to the upper edge portions of the walls.

The lower end 34 of the exterior diverter box is open to define a relief opening and, for safety purposes, the bottom relief opening is closed off by perforate grill 36. The grill extends between the opposing side walls and opposing end walls and is secured by an angle iron of open rectangular shape to form a mounting strip 38. The vertical flange of the strip 38 is securely affixed, as by metal screws, to the outer surfaces of the lower edge portions of the side and end walls and the edges of the grill are fixedly mounted on the horizontal flange 40 of the mounting strip so as to completely cover the bottom relief opening 34.

The interior of the diverter box 10 is centrally divided by a vertical baffle 42 which is composed of spaced apart panels 44 and 46 of sheet metal between which a packing 48 of insulation material, such as fiber glass, is sandwiched. The baffle has an upper channel strip 50 which sealingly engages the lower lid 24 of the cover 22 and the side edges 52 of the baffle are pop rivited, as at 54, to the opposing side walls 14 and 16 of the diverter box. In such manner, the baffle 42 is sealingly positioned centrally and vertically within the diverter box and is disposed midway between the opposing walls 18 and 20 to divide the upper portion of the elongate diverter box into a flue gas inlet section 56 and a vent gas outlet section 58. Such sections are provided with suitable thermometric means (not shown) to indicate exteriorly of the box what the temperatures are in the sections 56 and 58.

The perforate grill 36, which encloses the lower relief opening of the diverter box, supports a safety spill switch 60 which is tied into one leg of the automatic fuel control valve circuit (not shown) which, when activated, breaks the circuit and shuts off the fuel flow to the main burners through the fuel control valve. When the fuel control valve is open, fuel flows to the main burner where it is ignited by the pilot.

The diverter box 12 is disposed externally of the furnace 8 or other suitable gas or oil-fired appliance. The first step that is taken in the installation of the diverter box 12 is to remove the existing draft hood if it is a removable bonnet type, such as generally found on water heaters. Or, if the existing draft diverter is a factory built-in diverter in the casing of the furnace 8, the bottom or relief opening thereof is tightly sealed off so that the build-in diverter becomes a flue collector box. The diverter box 12 of the present invention is then attached to the outside of the appliance in a manner that will secure its positioning and so that the relief opening or the bottom grill 36 of the box is at the same elevation as the closed off bottom of the built-in diverter box within the appliance or, substantially about 34 inches above the burner ports 62 whichever is lower. It is important that the diverter box 12 have its relief opening or bottom grill 36 located just above or, at least, in the horizontal plane in which the built-in factory diverter box lies so that the relief opening of the diverter box is positioned well above the burner ports of the furnace. It is important that the relief opening be elevated, as specified above, so as to ensure maintenance of safe and proper burner operation and so that sufficient oxygen enters the combustion chamber to maintain carbon monoxide free combustion.

The upper portion of the diverter box is connected to the furnace 8 by a flue inlet pipe 62 and is connected to the chimney flue by an outlet pipe 64. The pipes may extend vertically through the cover 22 of the box or can be located horizontally to the rear of the box and enter the upper portion through the wall 14. On the other hand, the pipes can enter through the walls 18 and 20. It is only important that the pipe 62 from the furnace or appliance enter into the upper portion of the flue gas inlet section 56 while the pipe 64 communicate with the upper portion of the vent gas outlet section and the chimney flue (not shown).

The center baffle 42 depends in sealing tight engagement from the under side of the cover 22 into the interior of the diverter box while being in gas tight engagement of the cover and in gas tight engagement of the opposing walls 14 and 16. The lower free end 66 of the center baffle terminates above the grill 36 but the baffle extends more than half the vertical extent of the diverter box.

A turning vane 68 is mounted on the wall 16 below the lower end 66 of the baffle and is positioned at the lower portion of the flue gas inlet section 56. The turning vane includes a one-piece triangular member 70 having an upper side 72 and a lower side 74 with the free edges of the sides terminating in flanges that are fixed, as by pop riveting, to the inner surface of the wall 20 and extend the fuel extent thereof between the walls 18 and 20. The upper side 72, which actually constitutes the turning vane, is disposed at an angle to the wall 20 of approximately 75° downwardly sloped. The free end 78 of the turning vane is disposed below the lower end 66 of the center baffle.

For example, in dealing with a 7" by 15" diverter box, the turning vane is approximately 3½ inches with the angle of force of the turning vane being 75° downwardly sloped and the distance from the attached inner end of the vane to the bottom of the center baffle 66 being approximately 5⅛ inch. The distance from the outer free end 78 of the vane up to the bottom of the baffle is approximately 7 inches. Such type box handles a 5 and 6 inch flue gas pipe. The distance between the tip 78 of the turning vane and the lower end of the center baffle 66 is important and it is critical not to shrink such space so that the fumes have enough space to turn as they contact the turning vane and are turned by the turning vane under the baffle and upwardly into the gas vent outlet section 58.

The device serves for the evacuation of combustion products from the appliance 8 and is suitably attached exteriorly to the appliance, as shown in FIG. 1. Either horizontally or vertically disposed piping 62 and 64 extend out from the flue outlet of the appliance and the chimney flue and are communicated with the upper portion of the elongate diverter box 12 that is vertically oriented alongside and disposed exteriorly of the casing for the furnace 8 or other appliance. The insulated center baffle 42 divides the upper portion of the interior of the diverter box into the flue gas inlet section 56 and the vent gas outlet 58 with such sections being provided with the temperature indicators. The inlet section has the turning vane 68 attached to the wall 20 just below the lower end 66 of the center baffle. The relief opening is provided by the open bottom grill 36 of the box. The open bottom of the diverter box is located at or slightly above the level of the bottom of the closed off diverter box in the appliance, which constitutes a collector box. Thus, the heating appliance has a combustion chamber provided with the burners having flues leading to the collector box with the flue outlet for the outlet passages of the combustion gases leading to the upper portion of the diverter box 12. The relief opening is at or above the level of the bottom of the collector box and is in constant free communication with the atmospheric air surrounding the heating appliance which air enters through the opening in the bottom as cold air to establish a cold air pressure head below the sections and establish a thermal barrier to slow down the speed of the hot gases leaving the collector box in the appliance and also to prevent downdrafts from the chimney flue attempting to pass down through the vent gas outlet section from reaching the combustion chamber of the heating appliance. Otherwise stated, the gases, during the burn cycle, from the flue outlet of the appliance, enter into the flue gas inlet section 56 on one side of the center baffle 42 and are forced to travel downwardly where they engage the turning vane so that they are turned beneath the lower free end 66 of the center baffle and enter the vent outlet section 58 and travel on out the chimney flue through the piping 64. Such downward turn of the flue gases interrupts the conventional path of the heat from the appliance, such as the piping 62, direct to the chimney flue, as having the piping 62 in direct communication with the piping 64. This results in reduced velocity in the heat exchanger and reduced volume of excess air in the combustion chamber of the appliance. This is during the burn cycle. During the off cycle, this downward turn "locks in" the pilot heat and residual heat which will continue to be lost up the chimney flue with conventional venting systems.

The safety spill switch 60 operates when hot fumes in excess of 140° F. spill out the relief opening or grillwork 36 and serves to prevent potentially lethal fumes, possibly including carbon monoxide, from entering the building should the chimney flue become blocked.

Of course, while the preferred form of this invention has been described herein and shown in the attached drawing, it is to be understood that such is merely exemplary in nature and the scope of the invention is defined by dependent claims.

What is claimed is:

1. In combination with an oil or gas-fired appliance having a base, an upper portion and having a combustion chamber provided with a plurality of burners each having a flue leading to a collection box within the appliance and a flue outlet disposed in the upper portion for the outlet passage of combustion gases from the collector box to be conveyed to a chimney flue for the appliance: a venting system for the collector box of the combustion chamber comprising a first piping for the outlet of combustion gases from the collector box connected to the flue outlet, a second piping connected to the chimney flue, an elongate diverter box disposed in the path of the combination gases between the collector box and the chimney flue and vertically arranged exteriorly of the appliance and having a first and second set of opposing vertical walls and having an upper portion with a top wall and a lower portion, a heat resistant baffle depending from the top wall and sealingly transversely extending between the walls of one set of walls parallel with the walls of the second set and centrally disposed between the walls of the second set to divide the upper portion of the interior of the diverter box into a flue gas inlet section with which the first piping communicates and a vent gas outlet section with which the second piping communicates, said diverter box having a bottom in its lower portion provided with a substantial opening disposed well above the base of the appliance with said opening being at least at or above the horizontal level of the burners and in constant free communication with the atmospheric air surrounding the appliance which air enters the diverter box through the opening in the bottom to establish a thermal barrier, said baffle having a free lower end terminating a substantial distance above the opening in the bottom and a turning vane positioned slightly below the free lower end and carried by the wall of the second set on the flue gas inlet side of the baffle so that flue gases flowing downwardly in the flue gas inlet section impinge on the vane and are turned immediately under the lower end of the baffle to flow upwardly in the vent gas outlet section with the cold air entering through the opening in the bottom establishing a thermal barrier to slow down the speed of the hot gases in the flue gas inlet section, and with the baffle forming a heat lock in the combustion chamber to prevent heat waste through the chimney flue and with said turning vane being downwardly sloped from the carrying wall and having a free tip disposed below the free end of the baffle and between its carrying wall and the baffle.

2. The invention of claim 1 wherein said opening is closed off by a perforate grill.

3. The invention of claim 1 wherein the vane is sloped downwardly at an angle of approximately 75° relative to its carrying wall.

4. The invention of claim 1 wherein said baffle is composed of metal panels between which an insulation material is sandwiched.

5. The invention of claim 1 wherein said top wall consists of an insulated cover sealingly attached to the upper edge portions of the walls of the box.

* * * * *